US009375059B2

(12) United States Patent
Jin

(10) Patent No.: US 9,375,059 B2
(45) Date of Patent: Jun. 28, 2016

(54) SAFETY LOCK FOR ZIPPER BAGS

(71) Applicant: Hangzhou Golden Flame Packaging & Multi-Color Printing Co., Ltd, Hangzhou, Zhejiang (CN)

(72) Inventor: Haitao Jin, Anqing (CN)

(73) Assignee: HANGZHOU GOLDEN FLAME PACKAGING & MULTI-COLOR PRINTING CO., LTD, Hangzhou (CN)

( * ) Notice: Subject to any disclaimer, the term of this patent is extended or adjusted under 35 U.S.C. 154(b) by 19 days.

(21) Appl. No.: 14/523,971

(22) Filed: Oct. 27, 2014

(65) Prior Publication Data

US 2016/0088906 A1 Mar. 31, 2016

(30) Foreign Application Priority Data

Sep. 30, 2014 (CN) ..... 2014 1 0523997

(51) Int. Cl.

| | |
|---|---|
| ***A44B 19/24*** | (2006.01) |
| ***A44B 19/30*** | (2006.01) |
| ***B65D 33/25*** | (2006.01) |
| *A44B 19/26* | (2006.01) |

(52) U.S. Cl.

CPC ..... *A44B 19/303* (2013.01); *B65D 33/2591* (2013.01); *A44B 19/24* (2013.01); *A44B 19/26* (2013.01); *Y10T 24/2561* (2015.01); *Y10T 24/45241* (2015.01); *Y10T 24/45529* (2015.01)

(58) Field of Classification Search

CPC ..... A44B 19/32; A44B 19/30; A44B 19/26; A44B 19/303; Y10T 24/45; Y10T 24/45241; Y10T 24/45215; Y10T 24/45471; Y10T 24/45476; Y10T 24/58; Y10T 24/158; Y10T 24/45529; Y10T 70/5053; Y10T 24/2507; Y10T 24/45482; B65D 33/2591

USPC ..... 24/415, 418, 436, 604; 190/119, 120

See application file for complete search history.

(56) References Cited

U.S. PATENT DOCUMENTS

| | | | | | |
|---|---|---|---|---|---|
| 4,015,457 | A * | 4/1977 | Fukuroi | A44B 19/301 | 24/386 |
| 4,395,891 | A * | 8/1983 | Remington | A44B 19/301 | 70/68 |
| 4,976,120 | A * | 12/1990 | Terada | A44B 19/301 | 70/312 |
| 5,063,760 | A * | 11/1991 | Horita | A44B 19/301 | 70/23 |
| 5,103,657 | A * | 4/1992 | Horita | A44B 19/301 | 70/312 |
| 6,062,051 | A * | 5/2000 | Nam | A44B 19/301 | 70/312 |

(Continued)

*Primary Examiner* — Robert J Sandy
*Assistant Examiner* — Michael Lee

(57) ABSTRACT

The invention provides a safety lock for zipper bags, comprising a first pull block with a locking bar and a second pull block with a locking frame. Said locking bar is inserted into the locking frame to link the first pull block with said second pull block; said second pull block is further equipped with a release unit for detaching the locking bar from the locking frame. A slot is formed between said release unit and top surface of the second pull block. In the invention, the locking bar and the locking frame can connect and lock the two pull blocks which can be unlocked by pressing the pressing portions with certain force. Children are unable to open the zipper bag easily. Therefore, the invention can prevent children from mistakenly opening the zipper bag effectively and avoids loss of important documents and accidental ingestion of medicines.

8 Claims, 5 Drawing Sheets

(56) References Cited

U.S. PATENT DOCUMENTS 6,385,818 B1 * 5/2002 Savicki, Sr. ..... B65D 33/2591 24/30.5 R
6,431,754 B1 * 8/2002 Savicki, Sr. ..... A44B 19/267 156/73.1
6,510,593 B1 * 1/2003 Kim ..... A44B 19/301 24/382
7,073,233 B2 * 7/2006 Leva ..... A44B 19/26 24/386
7,979,964 B2 * 7/2011 Jans ..... A44B 19/301 24/386
8,893,356 B2 * 11/2014 Ozaki ..... B65D 33/2591 24/415
2005/0109072 A1 * 5/2005 Ling ..... A44B 19/301 70/68
2012/0023714 A1 * 2/2012 King ..... A45C 13/103 24/415
2014/0311101 A1 * 10/2014 Petkovsek ..... B65D 33/2591 53/480
2014/0311102 A1 * 10/2014 Petkovsek ..... B65D 33/2591 53/481
2016/0001930 A1 * 1/2016 Kirsh ..... B65D 33/34 24/30.5 L

* cited by examiner

SAFETY LOCK FOR ZIPPER BAGS

CROSS-REFERENCE TO RELATED APPLICATIONS

This present invention claims the benefit of Chinese Patent Application No. CN201410523997.9, filed on Sep. 30, 2014, the contents of which are hereby incorporated by reference.

FIELD OF THE INVENTION

The invention relates to a lock for zipper bags, particularly relates to a safety lock for zipper bags.

BACKGROUND

Zipper bags are common tools for storing items in daily life, especially for storing various documents or medicines, which possess a very good waterproof seal effect. But due to the lack of locking apparatus on the zipper of ordinary zipper bags in general, children can easily open the zipper bag, resulting in problems, such as loss of important documents or accidental ingestion of medicines, and poor safety.

SUMMARY

The invention provides a safety lock for zipper bags, which is used for locking zipper bags, preventing children from mistakenly opening and solving the said problems in the prior art.

The technical solution of the invention is as follows:

A safety lock for zipper bags comprises a first pull block with a locking bar and a second pull block with a locking frame, wherein said locking bar is inserted into said locking frame to link the first pull block with the second pull block; said second pull block is further equipped with a release unit for detaching the locking bar from the locking frame, a slot is formed between said release unit and the top surface of the second pull block.

As a further improvement of the invention, said locking bar is arranged at one end of said first pull block and extends out of said first pull block; said locking bar includes a connecting arm and a clamp at the tail end of the connecting arm.

As a further improvement of the invention, said locking frame includes an opening in which the clamp can be inserted in and a cavity communicated with said opening for containing the clamp.

As a further improvement of the invention, said release unit includes pressing portions on two sides of the locking frame and said pressing portions are provided with pressing heads.

As a further improvement of the invention, said cavity comprises a first inner wall and a second inner wall that forms an angle of 90°~135° with the first inner wall, said clamp includes a first side and a second side connected with the first side; said second side can cling to the second inner wall closely, and said first side can contact with the pressing heads of the pressing portions.

As a further improvement of the invention, said cavity comprises a third inner wall and a forth inner wall that forms an angle less than 90° with the third inner wall, said clamp extends outward relative to the connecting arm, said clamp includes a third side and a forth side that forms an obtuse angle with the third side, said third side can contact with the pressing heads of the pressing portions.

As the further improvement of the invention, a safety hole is respectively formed on the top of said first pull block and said second pull block.

As the further improvement of the invention, a safety hole is respectively formed on the top of said first pull block and said second pull block, a tamper hole is further formed on two sides of said first pull block respectively.

As the further improvement of the invention, a zipper slot is provided on bottom of said first pull block and said second pull block respectively, and an opening block for opening the zipper bag seal is arranged at one end of said zipper slot.

As a further improvement of the invention, there are multiple ridges on the side hand-held parts of said first pull block and said second pull block respectively.

The beneficial effects of the invention are as follows:

The locking bar and the locking frame can connect and lock the two pull blocks which can be unlocked by pressing the pressing portions with certain force. Children cannot open the zipper bag when they do not know how to open or not have enough force to press the pressing portions. Therefore, the invention prevents children from mistakenly opening the zipper bag effectively and avoids loss of important documents and accidental ingestion of medicines.

BRIEF DESCRIPTION OF THE DRAWINGS

In order to illustrate the technical solutions of the embodiments of the invention more clearly, the accompanying drawings used in the embodiments are briefly introduced herein. Obviously, the accompanying drawings in the following introduction are only some embodiments of the invention, ordinary technicians in the art can obtain the other drawings based on the following accompanying drawings without any creative work.

DETAILED DESCRIPTION

Based on the drawings, the technical solutions in the embodiments of the invention are described clearly and completely herein. Obviously, the described embodiments are only a part of the embodiments rather than all embodiments.

Embodiment 1

Figure 1:
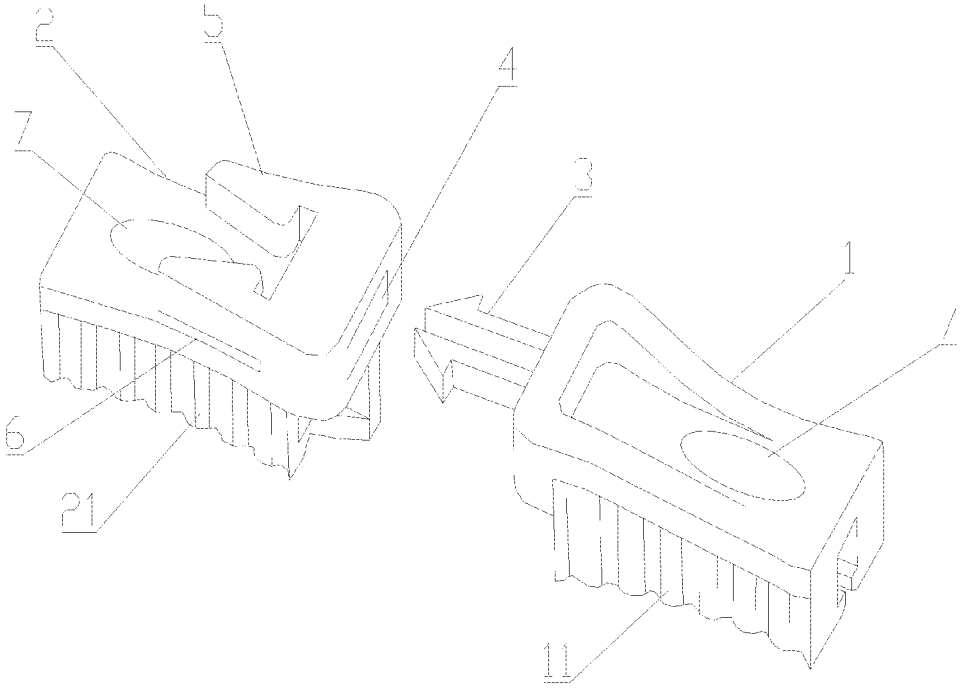
FIG. 1 is the structural schematic view of the first embodiment of the invention.
Figure 2:
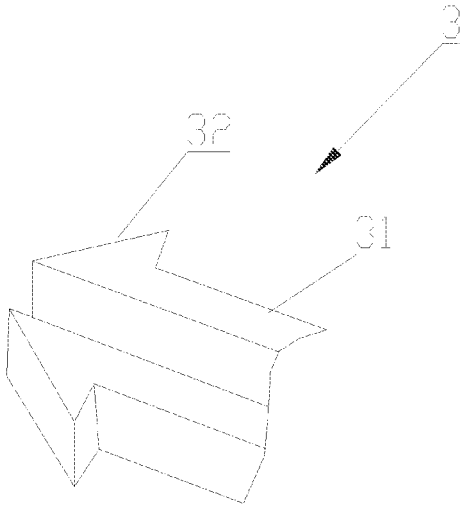
FIG. 2 is the partial enlarged view of the locking bar in the first embodiment of the invention.
Figure 3:
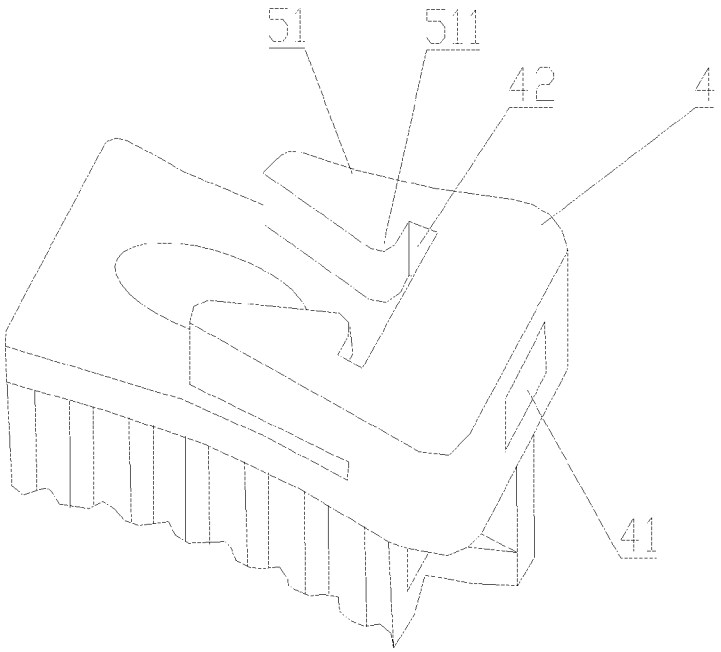
FIG. 3 is the structural schematic view of the second pull block in the first embodiment of the invention.

As shown in FIG. 1 to FIG. 3, in the embodiment, the safety lock for zipper bags comprises a first pull block 1 and a second pull block 2. One end of the first pull block is provided with a locking bar 3 extending out of the first pull block. The locking bar 3 includes a connecting arm 31 and a clamp 32 at the tail end of the connecting arm 31.

One end of the second pull block is provided with a locking frame 4 matched with the locking bar 3. The locking frame 4 includes an opening 41 in which the clamp 32 is inserted and a cavity 42 for containing the clamp 32 and communicating with the opening 41.

The locking bar 3 can be inserted into the locking frame 4 to link the first pull block 1 with the second pull block 2. The second pull block 2 is further equipped with a release unit 5 for detaching the locking bar 3 from the locking frame, and a slot 6 is formed between the release unit 5 and the top surface of the second pull block 2.

There are multiple ridges 11 and 21 on the side hand-held parts of the first pull block and the second pull block respectively to increase the friction force during holding. An oval safety hole is formed on the top of the first pull block 1 and the second pull block 2 respectively. The safety hole 7, on the one hand, plays air-feeding and water-feeding effects: the safety hole 7 can keep the air-feeding and water-feeding effects when children swallow the pull block into esophagus or trachea, thus avoiding more serious consequences. On the other hand, it has a tamper-evident function: the safety hole 7 can pass through the once-knotted rope; the other end of the rope is fixed in the zipper bag; the rope knot will be destroyed when the zipper bag is opened, thus whether the zipper bag is opened can be judged.

The release unit 5 includes two pressing portions 51 connected with the locking frame cavity 42. The two pressing portions 51 are arranged on two sides of the cavity 42 symmetrically and the pressing portions 51 are further provided with pressing heads 511.

Figure 4:
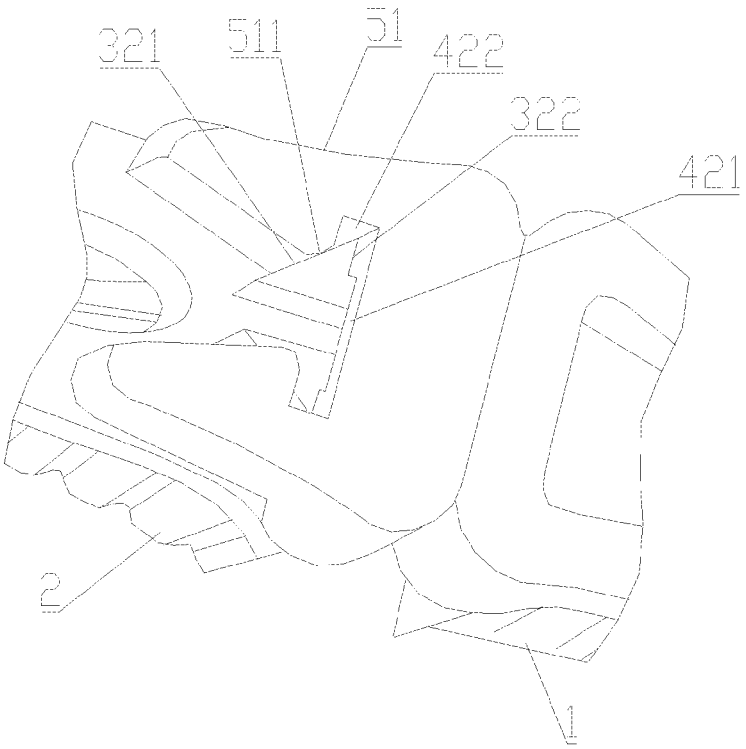
FIG. 4 is the partial connection schematic view of the first pull block and the second pull block when the first inner wall and the second inner wall form an angle of 90° in the first embodiment of the invention.
Figure 5:
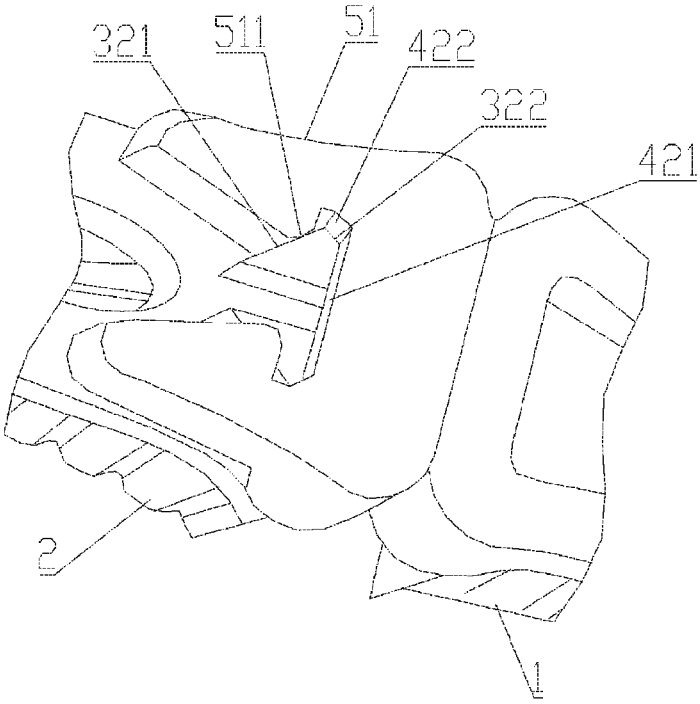
FIG. 5 is the partial connection schematic view of the first pull block and the second pull block when the first inner wall and the second inner wall form an angle of 135° in the first embodiment of the invention.

As shown in FIG. 4 and FIG. 5, the cavity 42 comprises a first inner wall 421 and a second inner wall 422 that forms an angle of 90°~135° with the first inner wall 421, wherein FIG. 4 is the schematic view when the first inner wall 421 and the second inner wall 422 form an angle of 90°~135°; FIG. 5 is the schematic view when the first inner wall 421 and the second inner wall 422 form an angle of 135°.

The clamp 32 comprises a first side 321 and second side 322 connected with the first side 321, wherein the angle between the first side 321 and the second side 322 is set so that the second side 322 clings to the second inner wall 422 closely and the first side 321 contacts with the pressing head 511 of the pressing portion 51.

Figure 6:
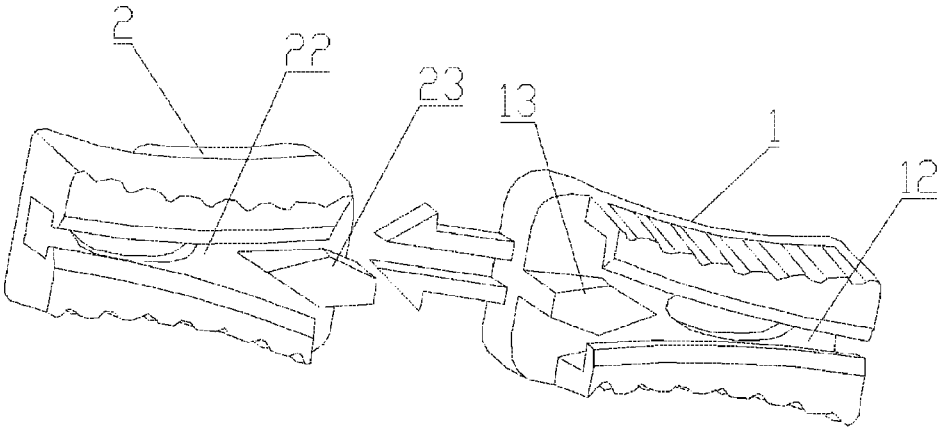
FIG. 6 is the schematic view of the bottom structure of the first embodiment of the invention.

As shown in FIG. 6, a first splayed zipper slot 12 is arranged at the bottom of the first pull block 1, one end of the first zipper slot 12 is provided with a first opening block 13 for opening the zipper bag seal; a second splayed zipper slot 22 is arranged at the bottom of the second pull block 2, one end of the second zipper slot 22 is provided with a second opening block 23 for opening the zipper bag seal.

The connecting arm 31 is elastic and can be bent and distorted when being stressed. When pushing the locking bar 3 towards the opening 41 of the locking frame 4, the clamp 32 is squeezed by the opening 41 so that the elongated connecting arm 31 is bent inwards and distorted. In addition, the clamp 32 is inserted into the cavity 42 of the locking frame 4; the connecting arm 31 rebounds after the clamp 32 is inserted into the cavity and the clamp 32 is stuck in the cavity 42 to lock the first pull block 1 and the second pull block 2 together.

When it is necessary to detach the first pull block 1 from the second pull block 2, pressing the pressing portions 51 with fingers, the pressing heads 511 squeeze the first side 321 of the clamp 32, which makes the connecting arm 31 bend and distort inwards and squeeze the clamp 32 out of the cavity to detach the first pull block 1 from the second pull block 2.

Figure 7:
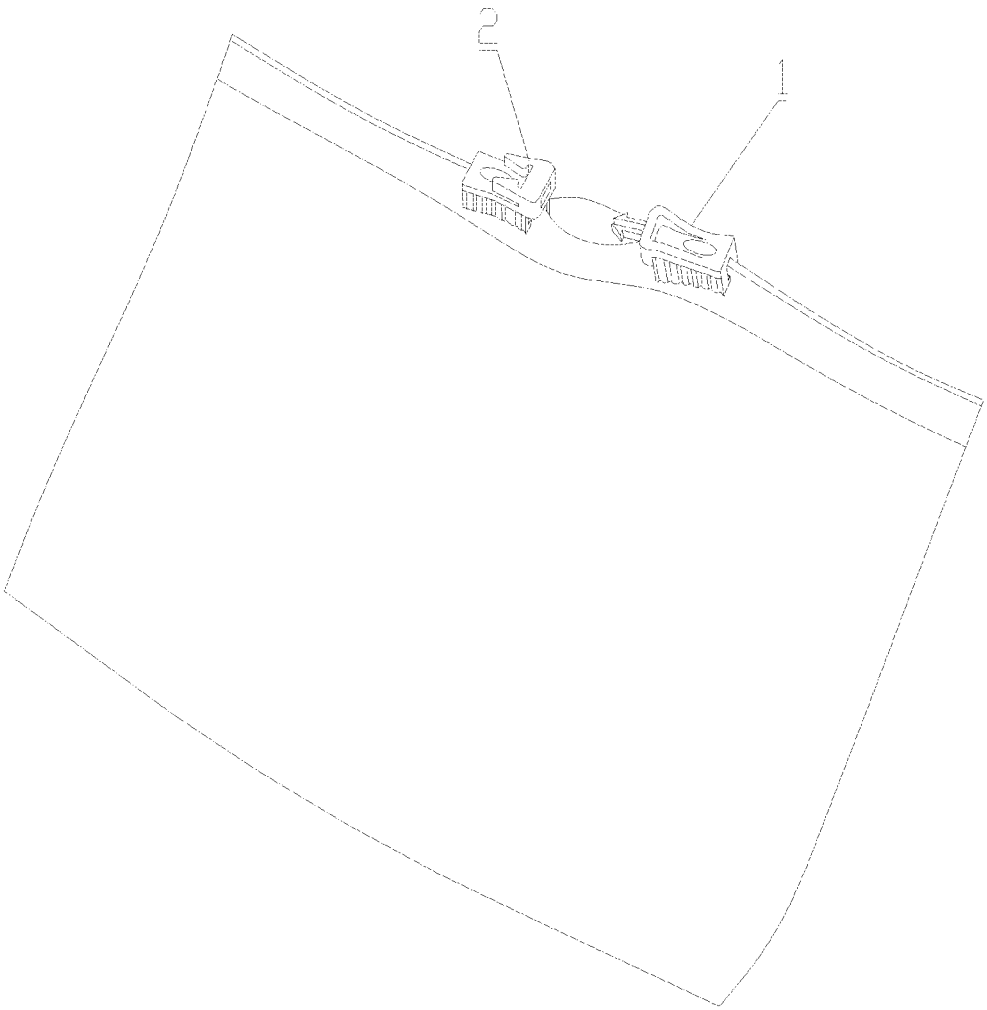
FIG. 7 is the using status reference view of the first embodiment of the invention.

FIG. 7 is the using status reference view of the invention. With this figure, the working principle an application fields of the invention can be easily understood.

The locking bar 3 and the locking frame 4 can connect and lock the two pull blocks 1, 2 which can be unlocked by pressing the pressing portions 51 with a certain strength, children cannot open the zipper bag when they do not know how to open or not have enough strength to press the pressing portions 51, therefore, the invention prevents children from mistakenly opening the zipper bag effectively and avoids loss of important documents and accidental ingestion of medicines.

Embodiment 2

The follows only describes the difference between the present embodiment and embodiment 1, and the unspecified structure is completely identical to the description of embodiment 1.

Figure 8:
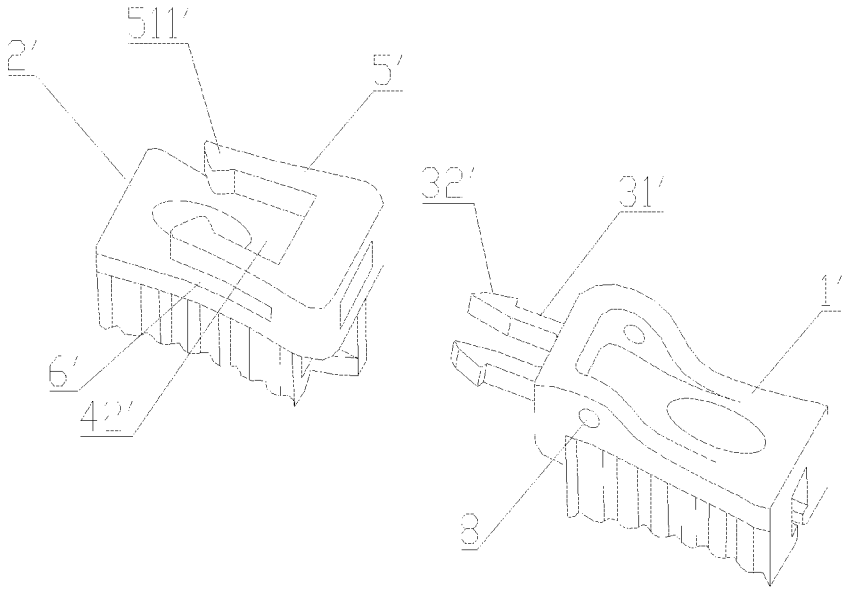
FIG. 8 is the structural schematic view of the second embodiment of the invention.
Figure 9:
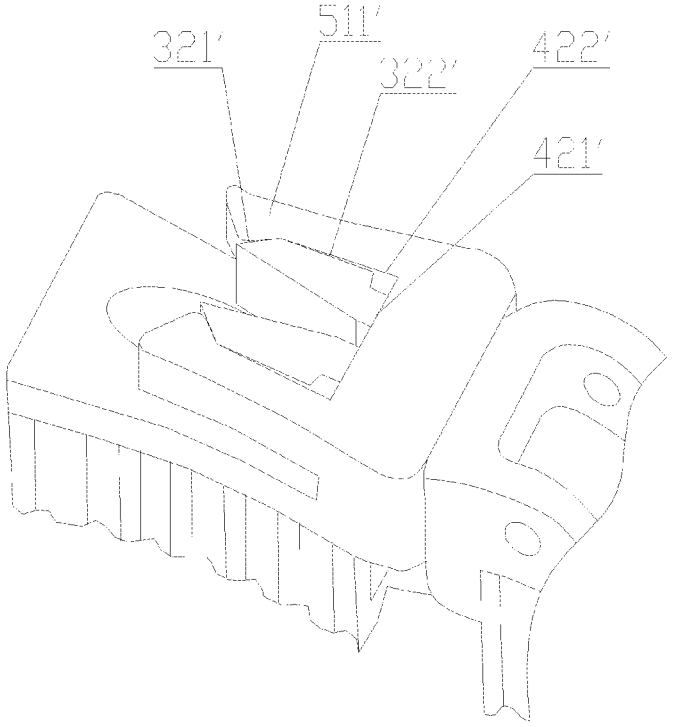
FIG. 9 is the partial connection schematic view of the first pull block and the second pull block in the second embodiment of the invention.

As shown in FIG. 8 and FIG. 9, the pressing head 511' is arranged at the tail end of the pressing block 5', the cavity 42' includes a third inner wall 421' and a fourth inner wall 422' that forms an angle less than 90° with the third inner wall 421'. The clamp 32' spreads outwards relative to the connecting arm 31', the clamp 32' includes a third side 321' and a fourth side 322' that forms an obtuse angle with the third side 321'. The third side 321' can contact with the pressing heads 511'. The locking and detachment theories of the first pull block 1' and the second pull block 2' are completely consistent with those of embodiment 1. Thus repeated description is not given herein.

A tamper hole 8 is further formed on two sides of the first pull block 1' respectively. The tamper hole 8 and the slot 6' of the second pull block 2' will be connected by common snap buttons or bead ties on the market. The snap buttons or bead ties should be cut off if the zipper bag is required to be opened, which can achieve the tamper-evident effect.

The embodiments above are only the preferred embodiments of the invention, and are not used to impose restrictions on the invention. Any amendment, equivalent replacement and improvement without departing from the spirit and principle of the invention are to be embraced within the scope of protection of the invention.

What is claimed is:

1. A safety lock for zipper bags, comprising a first pull block with a locking bar and a second pull block with a locking frame, wherein the locking bar is inserted into said locking frame to link the first pull block with the second pull block; said second pull block is further equipped with a release unit for detaching the locking bar from the locking frame, and a slot is formed between said release unit and top surface of the second pull block;

wherein said locking bar is arranged at one end of the first pull block and extends out of the first pull block; said locking bar includes a connecting arm and a clamp at the tail end of the connecting arm;

said locking frame includes an opening in which the clamp can be inserted in and a cavity communicated with said opening for containing the clamp; and said release unit includes pressing portions on two sides of the locking frame and the pressing portions are provided with pressing heads.

2. The safety lock for zipper bags according to claim 1, wherein said cavity comprises a first inner wall and a second inner wall that forms an angle of 90°~135° with the first inner wall, said clamp includes a first side and a second side connected with the first side; said second side can cling to the second inner wall closely, and said first side can contact with the pressing heads of the pressing portions.

3. The safety lock for zipper bags according to claim 1, wherein said cavity comprises a third inner wall and a fourth inner wall that forms an angle less than 90° with the third inner wall; said clamp spreads outwards relative to the connecting arm; said clamp includes a third side and a fourth side that forms an obtuse angle with the third side, and said third side can contact with the pressing heads of the pressing portions.

4. The safety lock for zipper bags according to claim 2, wherein a safety hole is formed on the top of said first pull block and said second pull block respectively.

5. The safety lock for zipper bags according to claim 3, wherein a safety hole is formed on the top of said first pull block and said second pull block respectively; a tamper hole is further formed on two sides of said first pull block respectively.

6. The safety lock for zipper bags according to claim 4, wherein a zipper slot is provided on bottom of said first pull block and said second pull block respectively, and an opening block for opening the zipper bag seal is arranged at one end of the zipper slot.

7. The safety lock for zipper bags according to claim 5, wherein a zipper slot is provided on bottom of said first pull block and said second pull block respectively, and an opening block for opening the zipper bag seal is arranged at one end of the zipper slot.

8. The safety lock for zipper bags according to claim 6, wherein there are multiple ridges on the side hand-held parts of said first pull block and said second pull block respectively.

* * * * *